US006810942B2

(12) United States Patent
Rittner et al.

(10) Patent No.: US 6,810,942 B2
(45) Date of Patent: Nov. 2, 2004

(54) DEVICE FOR THE CONTINUOUS CASTING OF METALS, ESPECIALLY STEEL, FOR USE IN A SOLIDIFIED BENDING METHOD

(75) Inventors: Karl Rittner, Hilden (DE); Günter Kneppe, Hilchenbach (DE); Jürgen Müller, Kaarst (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/398,346

(22) PCT Filed: Sep. 22, 2001

(86) PCT No.: PCT/EP01/10968

§ 371 (c)(1),
(2), (4) Date: Oct. 10, 2003

(87) PCT Pub. No.: WO02/28570

PCT Pub. Date: Apr. 11, 2002

(65) Prior Publication Data

US 2004/0045695 A1 Mar. 11, 2004

(30) Foreign Application Priority Data

Oct. 6, 2000 (DE) ..... 100 49 445

(51) Int. Cl.[7] ..... B22D 11/12
(52) U.S. Cl. ..... 164/442; 164/417; 164/424
(58) Field of Search ..... 164/442, 484, 164/417, 424, 476, 483

(56) References Cited

U.S. PATENT DOCUMENTS 3,911,995 A 10/1975 Yu
5,803,155 A * 9/1998 Lavazza et al. ..... 164/417
6,536,505 B1 * 3/2003 Pleschiutschnigg ..... 164/417

FOREIGN PATENT DOCUMENTS

| | | |
|---|---|---|
| DE | 1 223 111 | 8/1966 |
| DE | 31 50 175 | 7/1982 |
| DE | 19637545 | 3/1998 |

* cited by examiner

*Primary Examiner*—Kiley Stoner
*Assistant Examiner*—I.-H. Lin
(74) *Attorney, Agent, or Firm*—Sidley Austin Brown & Wood, LLP

(57) ABSTRACT

The invention relates to a device for the continuous casting of metals, especially steel, for use in a solidified-bending method. Said device comprises, downstream of the continuous casting mold, a straight strand guide (1) and a bending device (3) that releases the cast strand path (2*a*) so that the cold strand (5) can be introduced. The object of the invention is to utilize the height of the device that has so far not been used for supporting the strand or to reduce the height of the entire installation. To this end, the bending device (3) comprises a folding segment (9) that is pivoted on the fixed side (1*a*) and that is provided with a row of rollers (10) that limit the bending path (3*c*) in the operational position. The bending device further comprises on the loose side (1*b*) a loose element (11) that can be swiveled into the operational position (3*b*) or that can be swiveled out from this position. The bending rollers (3*a*) of said loose element form the counter-rollers (3*d*) to the row of rollers (10) in the operational position (3*b*).

11 Claims, 8 Drawing Sheets

2
1
1a
1b
23
12
11
9
3d
3
6
7
3a
14
19
22
13
18
21
2a
700
24
5

DEVICE FOR THE CONTINUOUS CASTING OF METALS, ESPECIALLY STEEL, FOR USE IN A SOLIDIFIED BENDING METHOD

CROSS REFERENCE TO RELATED APPLICATION

This application is a 371 of PCT/EP01/10968, filed on Sep. 22, 2001.

BACKGROUND OF THE INVENTION

1. Field of the Invention

The invention relates to a device for continuous casting of metals, in particular, steel, for use in a solidified bending process and including a vertical strand guide located downstream of a continuous casting mold, a bending driver adjoining the strand guide and bending rollers of which reciprocate between a cold strand (starter bar) path-releasing position and an operational position, a bending device for separating a cold strand from a hot strand and for guiding the hot strand along a radius to a following straightening driver, and at least one, lower-lying drive roller pair for inserting or withdrawing the cold strand.

2. Description of Related Art

The device described above is disclosed in DE 196 37 545 A1. There, a device for diverting a thin slab, which is cast in a continuous casting mold, from a vertical in a horizontal direction with the listed features, is described. With such CSP-casting machines, the strand guide is formed as a vertical part. This provides a number of advantages. Beneath the strand guide, which adjoins the continuous casting mold, there is arranged a bending driver that performs the functions of "driving hot and cold strand" and bending of a solidified hot strand in a radius. The radius varies between 3000 and 3250 mm in many generations of CSP-casting machines.

The bending driver with the radius require a height of about 4,000 mm. This height and an associated strand path, up to the present, have not been used in a strand guide.

An object of the present invention is to utilize the height, which up to the present has not been used, for guiding the strand or to reduce the total height.

SUMMARY OF THE INVENTION

The object of the invention is achieved according to the invention, based on the device described above, by providing a bending driver consisting, on the one hand, of a folding segment pivotally supported on a fixed side and provided with a row of rollers which limit a bending path in an operational position and, on the other hand, of a loose element displaceable or pivotable, on a loose side, into and out of the operational position and bending rollers of which form, respectively, in the operational position, counter-rollers to rollers of the roller row, by displacing the loose element in and out of the operational position with paired, extending parallel to each other piston-cylinder units, and by displacing the loose element in a free space with respect to the hot strand for overbending, i.e., for separating the hot strand from the cold strand.

Thereby, not only all of the functions of a conventional bending driver are performed, while retaining a cold strand system of a straight cold strand that has proved itself but, in addition, an increased strand support length is obtained due to the segmented construction and addition of guide rollers. Moreover, the production output can be noticeably increased. Further, the existing CSP-plants can be easily modified with little costs as the existing base elements can be used. The folding segment can be formed as a vertical segment as all other strand guide segments. The path of the cold strand becomes reduced, and a separation of the strand guide into the folding segment and the loose element takes place.

According to further features of the invention, in order to limit the path of the introduction of the cold strand the folding segment, which is located on the fixed side, is supported on an above-located pivot axle and is connected with a hydraulic piston-cylinder unit, which is located opposite the pivot axle, for displacement in and out of the operational position.

A further improvement consists in that in the region of the vertical strand guide, on the fixed side, there is provided a base frame which supports the piston-cylinder unit for the folding segment. Thereby, the hydraulic cylinder can be supported on a base.

Also, a heat protection can be provided, with the base frame being provided, on its side facing the vertical strand guide, with water-cooled bolster plates.

The opening width for the cold strand can further be widened, with a longer strand guide, by providing in the folding segment, according to an alternative proposition, of a segment element which reciprocates on the folding segment transverse to a direction of the cast strand.

Further function can be obtained by providing on the folding segment, remotely from the cast strand path, a projection with which the piston cylinder unit for pivoting the folding segment is connected.

According to further features, the displaceable, in the folding segment, segment element is provided with its own displacement drive.

In order to further lengthen the strand guide and thereby to reduce the plant height, it is proposed to arrange in a strand displacement direction, behind the folding segment and in front of the straightening driver, a circular strand guide segment.

With a corresponding height of the plant, the strand guide can further be lengthened by arranging in the strand displacement direction, in front of the folding segment, an additional vertical element.

According to another arrangement of the folding segment, the folding segment is arranged on the frame of the drive roller pair for the cold strand and is vertically extended.

A further advantage consists in that the piston-cylinder units of the loose element, in connection with a following liquid core reduction, are hydraulically controlled.

The embodiments of the invention, which are shown in the drawings, will be described in detail below.

DETAILED DESCRIPTION OF THE PREFERRED EMBODIMENTS

Figure 1:
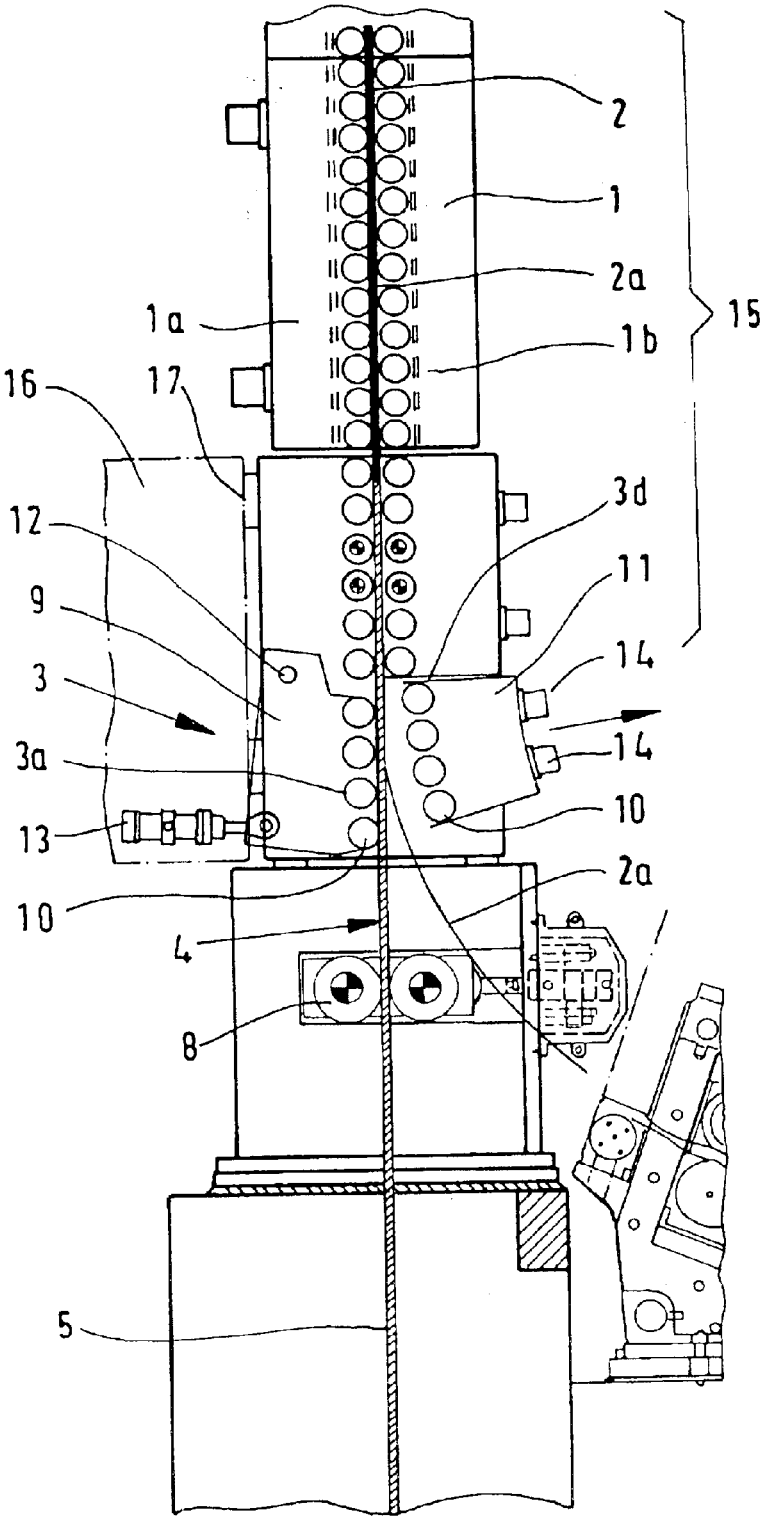
FIG. 1 a side view of a continuous casting device upon insertion of a cold strand.

The device for continuous casting of metal, in particular steel, is used in a solidified-bending process at which a hot strand 2 solidifies upon passing through a vertical, straight strand guide 1 arranged downstream of an end of a continuously casting mold. A bending driver 3 adjoins the straight strand guide 1. The bending driver 3 has bending rollers 3*a* that move from a position in which they release the cold strand path 4, into an operational position and back. Besides, there is provided a bending device for separating a hot strand 2 from a cold strand 5. The bending driver 3 guides the hot strand after separation along a radius 6 in a straightening driver 7. A located downstream, drive roll pair 8 serves for insertion or withdrawal of the cold strand 5.

Figure 3:
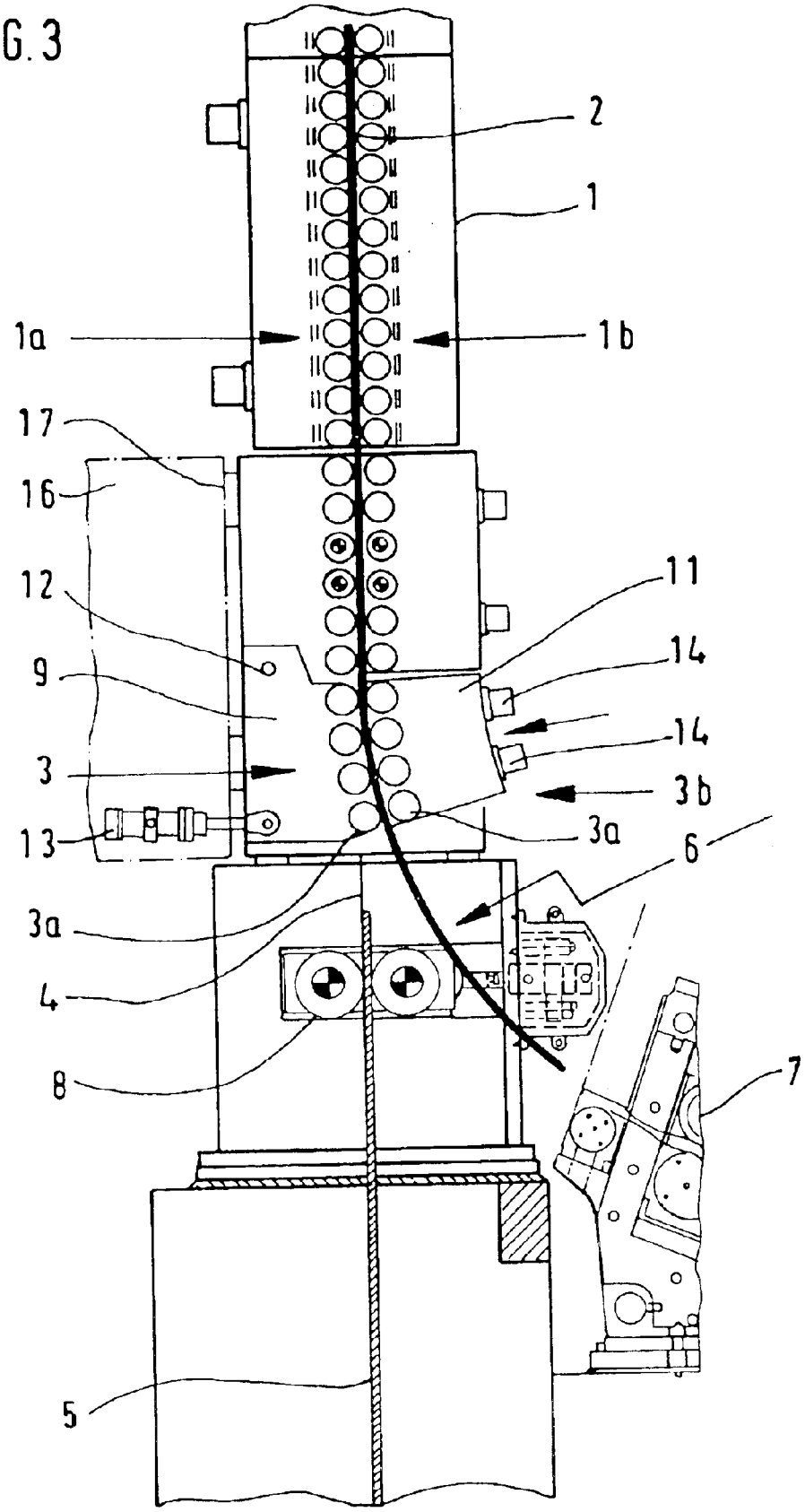
FIG. 3 the same side view upon setting of loose elements in an operational position.

As shown in FIG. 1, the bending driver 3 includes folding segment 9 pivotally supported on a fixed side 1*a* and provided with a row of 10 rollers which limit the bending path 3*c* in the operational position 3*b* (FIG. 3). Opposite the folding segment 9, on the loose side 1*b*, there is provided a loose element 11 pivotable in and out of the operational position 3*b* and the bending rollers 3*a* of which form, respectively, counter-rollers 3*d* to the separate rollers of the row 10 in the operational position 3*b*.

The folding segment 9, which is provided on the fixed side 1*a*, is pivotally supported on an axle 12 in the upper portion thereof. Opposite the pivot axle 12, at least one hydraulic piston-cylinder unit 13 is connected to the folding segment 9 for displacing it into and out of the operational position 3*b*.

Opposite the folding segment 9, on a loose side 1*b*, there is provided an adjustable loose element 11 adjustable with paired, arranged parallel to each other, piston-cylinder units 14.

In the region 15 of the vertical strand guide 1, on the fixed side 1*a*, there is provided a base frame 16 that supports the piston-cylinder unit 13 for the folding segment 9.

The base frame 16 is provided, at least on its side facing the vertical strand guide 1, with water-cooled bolster plate 17.

Figure 2:
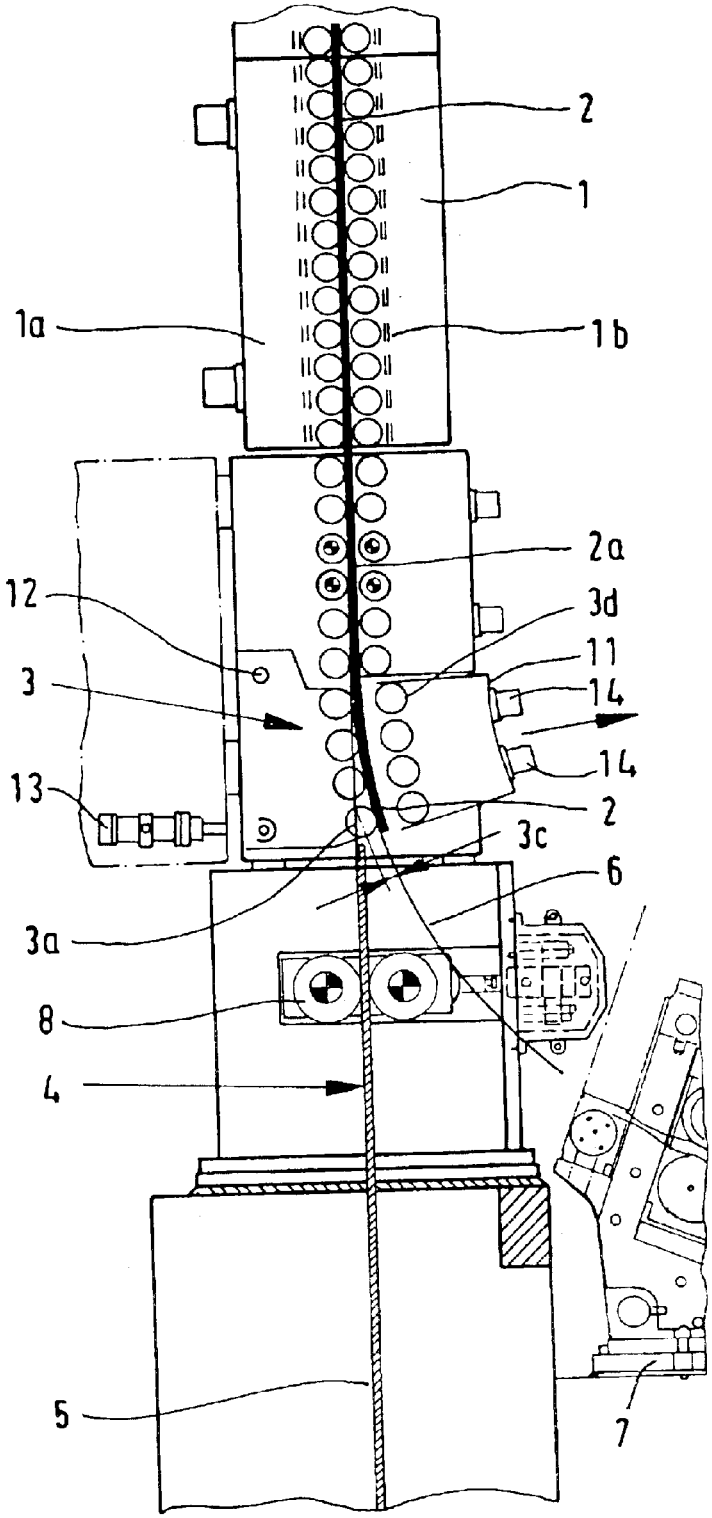
FIG. 2 the same side view upon separation of the hot strand from the cold strand.

The loose element 11 (FIG. 2) is adjustable in a free space on the loose side 1*b* to provide for its overbending, i.e., for separating the hot strand 2 from the cold strand 5.

FIG. 3 shows the folding segment 9 and the loose element 11 in the operational position 3*b*, with the cold strand 5 being lowered and the hot strand 2 being movable into the straightening driver 7.

Figure 4:
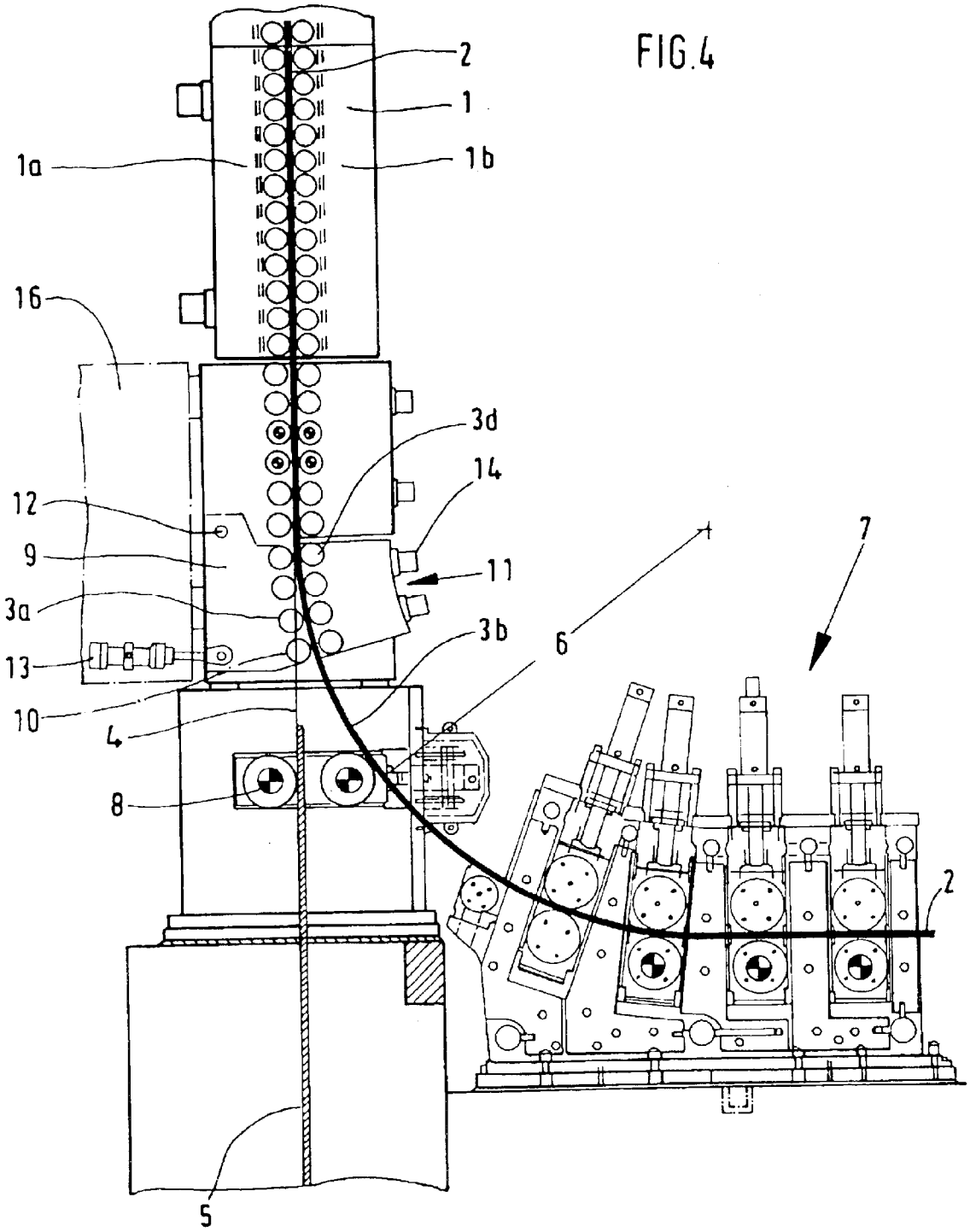
FIG. 4 the side view of the continuously casting device with a continuously operating straightening driver.

In the operational position shown in FIG. 4, the hot strand 2 is continuously guided through the bending driver 3 and past an outer roller of a drive roller pair into the straightening driver 7.

The alternative embodiment with the otherwise the same functions and processes is shown in FIGS. 5–8.

Figure 5:
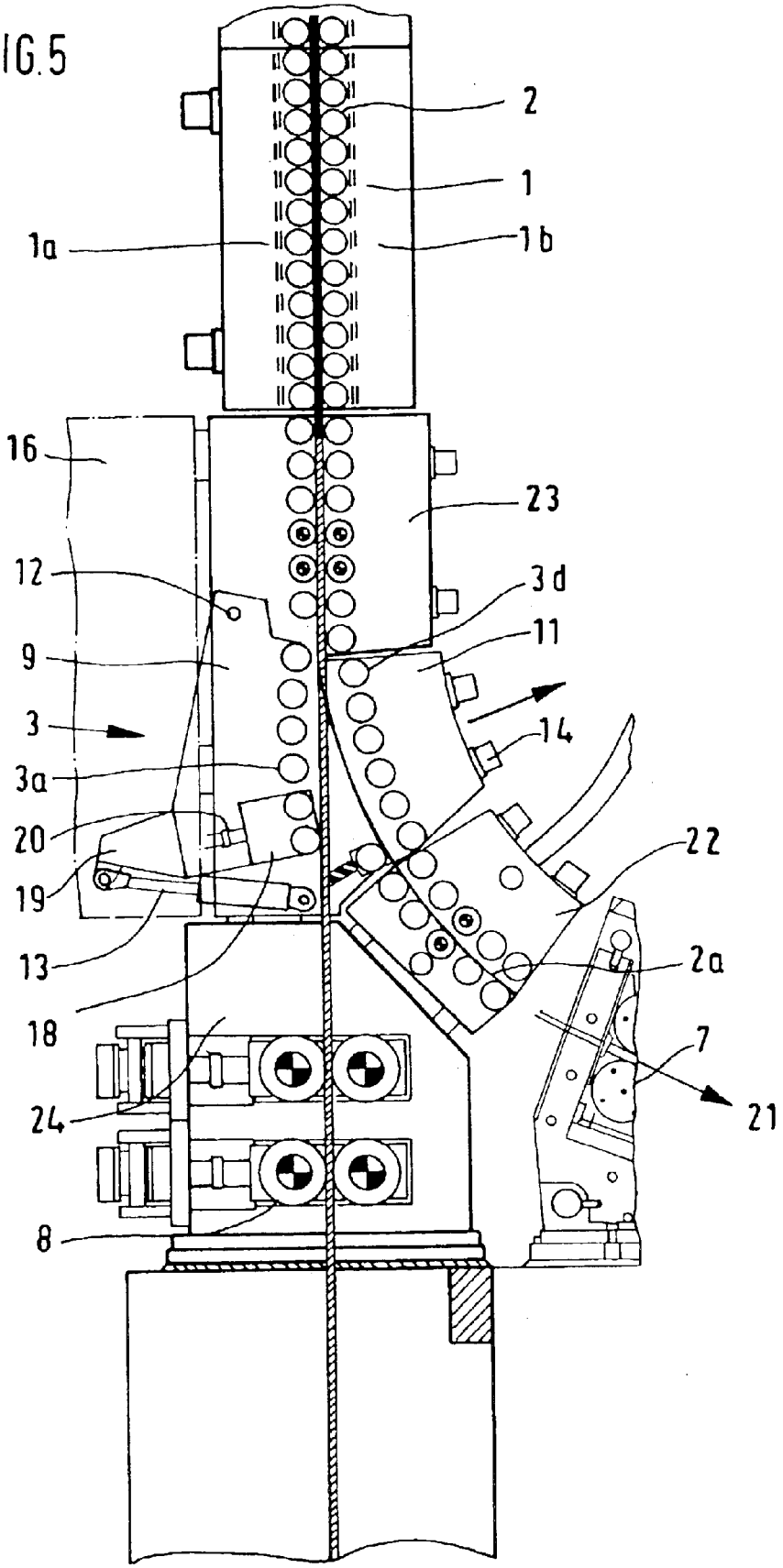
FIG. 5 a side view of an alternative embodiment of a continuous casting device and in which the folding segment includes a segment element lying outside of an operational position upon insertion of a cold strand.
Figure 6:
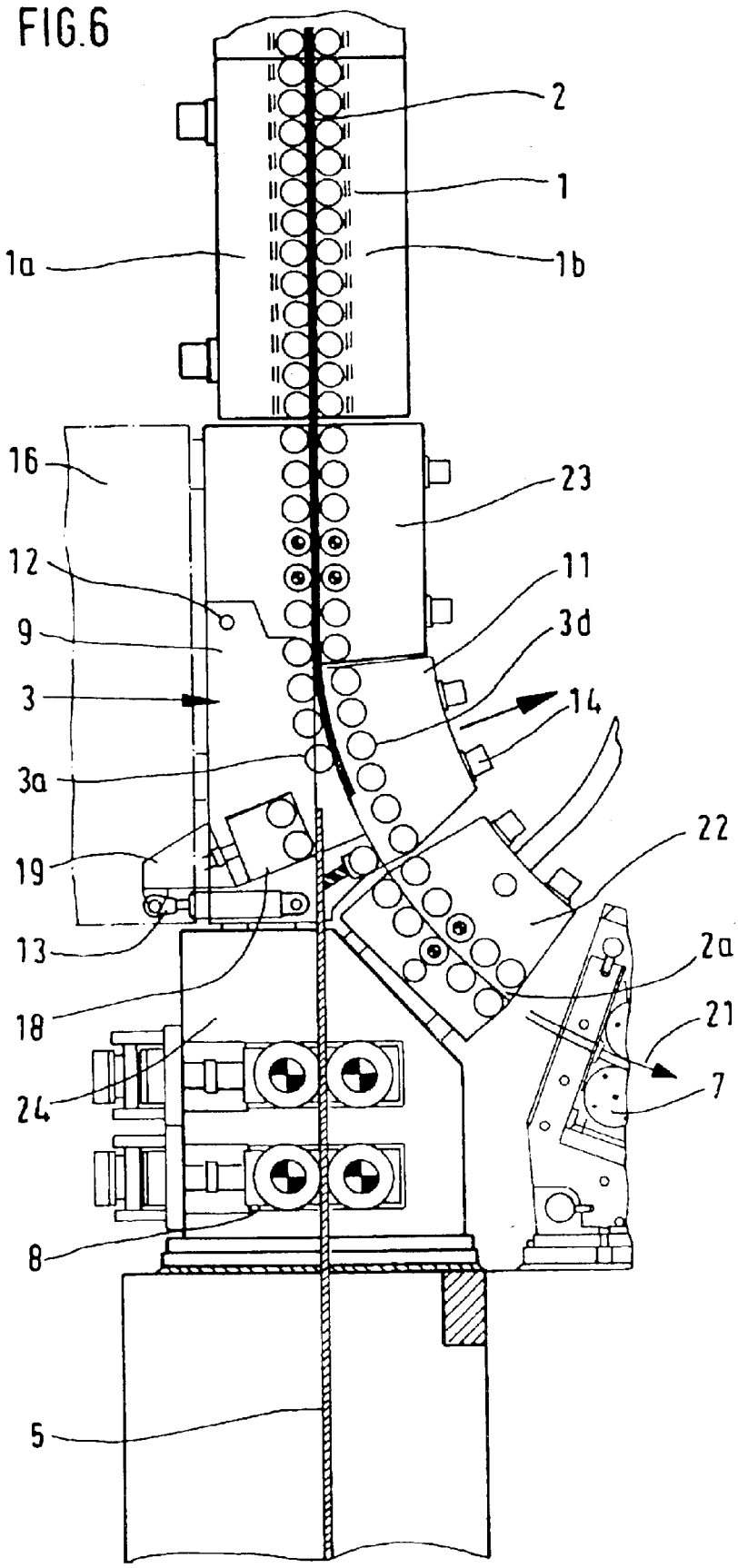
FIG. 6 the same side view upon separation of the hot strand from the cold strand.
Figure 7:
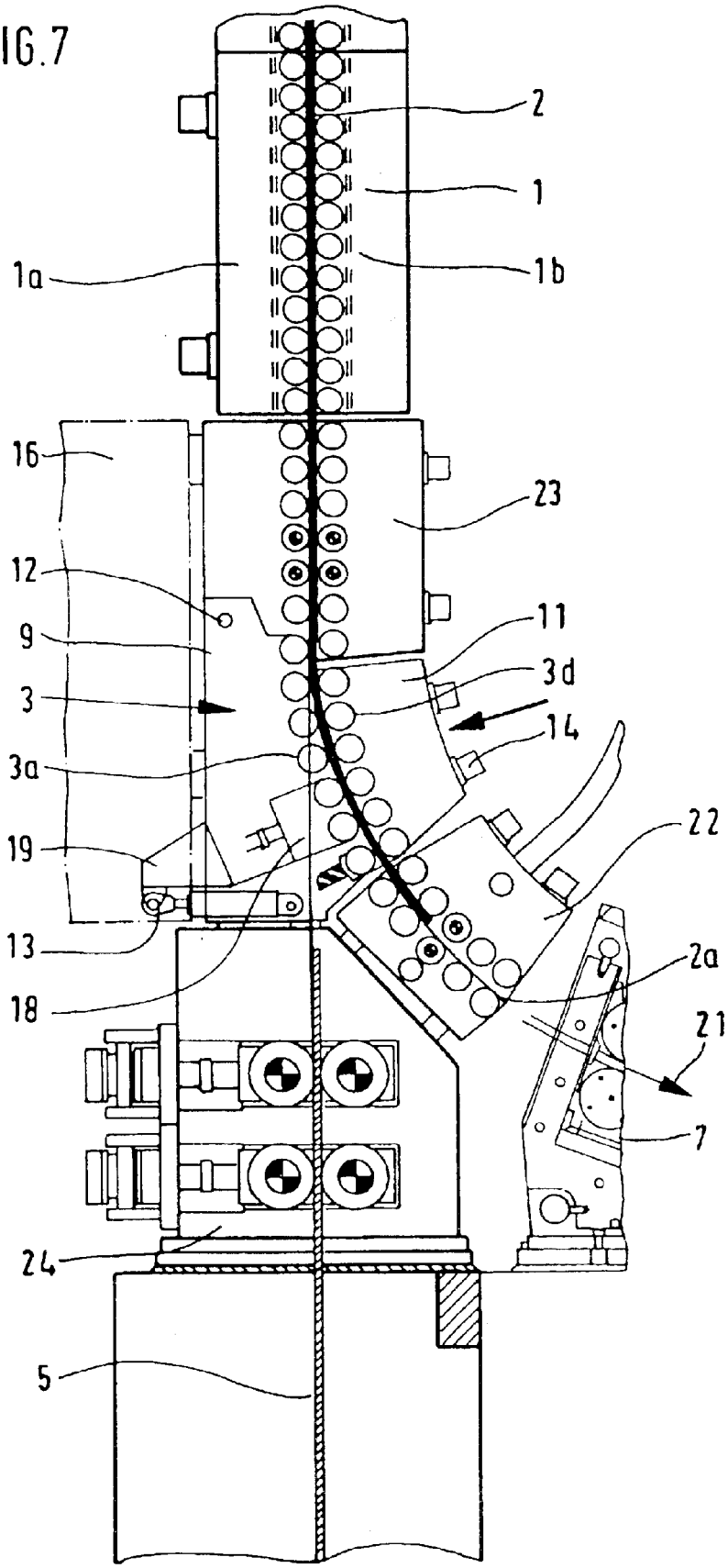
FIG. 7 the same side view with the folding segment, segment element, and a loose element being in an operational position.
Figure 8:
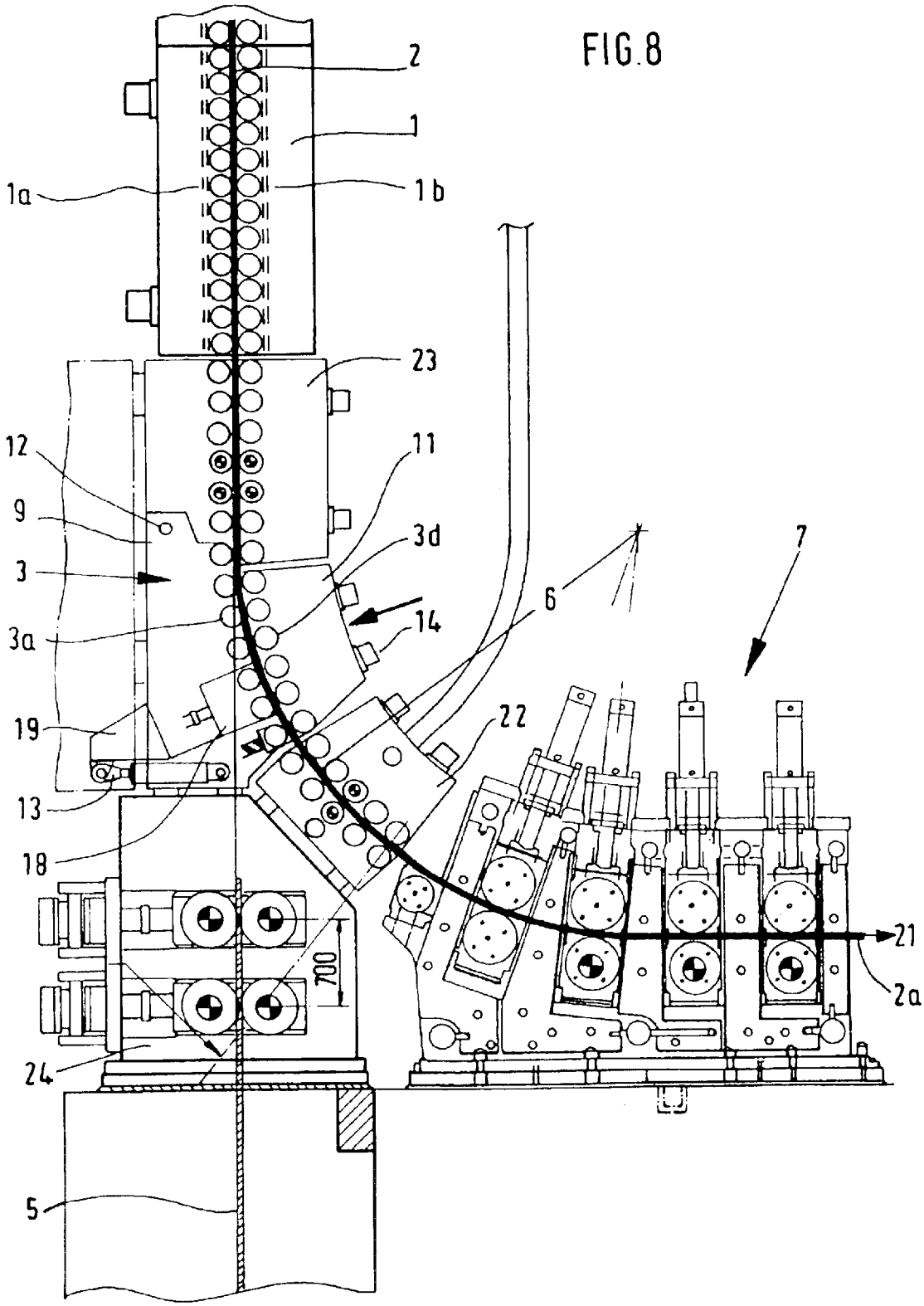
FIG. 8 a side view of the continuously casting device, with folding segment and the segment element in an operational position and with a continuously operated straightening driver.

Within the pivotal folding segment 9, a segment element 18 reciprocates in guides of the folding segment 9 transverse to the continuous casting path 2*a* (FIG. 5). Thereby, an even larger opening width for passing of the cold strand 5 is formed, whereby the strand guide, i.e., the number of rollers in the roller row 10 can be increased. The folding segment becomes even longer. Remotely from the cast strand path 2*a*, a projection 19 is provided on the folding segment 9 with which the piston-cylinder unit 13 for pivoting the folding segment 9 is connected. A segment element 18, which displaces within the folding segment 9, is equipped with its own displacement drive 20.

The entire strand guide can further be lengthened. To this end, behind the folding segment 9, in the direction of movement of the strand 21, and in front of the straightening driver 7, there is arranged a circular strand guide segment 22. The strand guide becomes even longer further down by using the space that has not been used previously, so that the entire length can further be reduced.

An additional lengthening of the strand support in the strand movement direction 21 can be achieved by providing a vertical section 23 upstream of the folding segment 9.

The folding segment 9 can also be supported on a frame 24 of the drive roller pair 8 for the cold strand and, thus, be extended.

Finally, the piston-cylinder unit 14 of the loose element 11 in connection with the following LCT (liquid-core-reduction) is hydraulically controlled.

Reference Numerals

1 Vertical straight strand guide
1*a* Fixed side
1*b* Loose side
2 Hot strand
2*a* Cast strand path
3 Bending driver
3*a* Bending rollers
3*b* Operational position
3*c* Bending path
3*d* Counter-rollers
4 Cold strand path
5 Cold strand
6 Radius
7 Straightening driver
8 Drive roller pair for a cold strand
9 Folding segment
10 Roller row
11 Loose element
12 Pivot axle
13 Hydraulic piston-cylinder unit
14 Hydraulic piston-cylinder unit
15 Region of the vertical strand guide
16 Base frame
17 Water-cooled bolster plate
18 Segment element
19 Projection
20 Displacement drive
21 Strand movement direction
22 Circular strand guide segment
23 Vertical section
24 Frame

What is claimed is:

1. A device for continuous casting of metals, in particular steel, for use in a solidified bending process, comprising a vertical strand guide located downstream of a continuous casting mold, a bending driver adjoining the strand guide and bending rollers of which reciprocate between a cold strand path-releasing position and an operational position, a bending device for separating a cold strand from a hot strand for guiding the hot strand along a radius to a following straightening driver, and at least one, lower lying drive roller pair for inserting or withdrawing the cold strand, characterized in that the bending driver (3) consists, on one hand, of a folding segment (9) pivotally supported on a fixed side and provided with a row (10) of rollers which limit a bending path (3*c*) in an operational position (3*b*) and, on the other hand, of a loose element (11) displaceable or pivotable, on a loose side (1*b*), into and out of the operational position (3*b*) and bending rollers (3*a*) of which form, respectively, in the operational position (3*b*), counter-rollers (3*d*) to rollers of the roller row (10); the adjustable loose element (11) is displaceable into and out of the operational position (3*b*) with paired, arranged parallel to each other, piston-cylinder units (14); and the loose element (11) is displaceable in a free space on the loose side (1*b*) with respect to the hot strand for overbending, i.e., for separating the hot strand (2) from the cold strand (5).

2. A device according to claim 1, characterized in that the folding segment (9), which is located on the fixed side (1*a*), is supported on an above-located pivot axle (12) and is connected with a hydraulic piston-cylinder unit (13), which is located opposite the pivot axle (12), for displacement in and out of the operational position (3*b*).

3. A device according to claim 1, characterized in that in the region (15) of the vertical strand guide (1), on the fixed side (1*a*), there is provided a base frame (16) with which the piston-cylinder unit (13) for the folding segment (9) is connected.

4. A device according to claim 3, characterized in that the base frame (16) is provided, on a side thereof facing the vertical strand guide (1) with water-cooled bolster plates (17).

5. A device according to claim 1, characterized in that within the folding segment (9), a segment element (18) reciprocates on the folding segment (9) transverse to a direction of the cast strand path (2*a*).

6. A device according to claim 5, characterized in that on the folding segment (9), remotely from the cast strand path (2*a*), there is provided a projection (19) with which the piston cylinder unit (13) for pivoting the folding segment (9) is connected.

7. A device according to claim 6, characterized in that the displaceable, in the folding segment (9), segment element (18) is provided with its own displacement drive (20).

8. A device according to claim 1, characterized in that in a strand displacement direction (21), behind the folding segment (9) and in front of the straightening driver (7), a circular strand guide segment (22) is arranged.

9. A device according to claim 1, characterized in that in the strand displacement direction (21), in front of the folding segment (9), an additional vertical element (23) is arranged.

10. A device according to claim 1, characterized in that the folding segment (9) is arranged on a frame (24) of the cold strand drive roller pair (8) and is vertically extended.

11. A device according to claim 1, characterized in that the piston-cylinder units (14) of the loose element (11), in connection with a following liquid core reduction, are hydraulically controlled.

* * * * *